US009091259B2

(12) United States Patent
Tamminen et al.

(10) Patent No.: US 9,091,259 B2
(45) Date of Patent: Jul. 28, 2015

(54) METHOD AND CONTROLLER FOR OPERATING A PUMP SYSTEM

(71) Applicant: ABB Oy, Helsinki (FI)

(72) Inventors: Jussi Tamminen, Lappeenranta (FI); Juha Viholainen, Espoo (FI)

(73) Assignee: ABB TECHNOLOGY OY, Helsinki (FI)

( * ) Notice: Subject to any disclaimer, the term of this patent is extended or adjusted under 35 U.S.C. 154(b) by 237 days.

(21) Appl. No.: 13/667,910

(22) Filed: Nov. 2, 2012

(65) Prior Publication Data

US 2013/0108473 A1 May 2, 2013

(30) Foreign Application Priority Data

Nov. 2, 2011 (FI) ..... 20116080

(51) Int. Cl.

| | |
|---|---|
| ***F04B 49/06*** | (2006.01) |
| ***F04B 49/00*** | (2006.01) |
| ***F04B 23/04*** | (2006.01) |
| ***F04B 23/06*** | (2006.01) |
| ***F04B 49/10*** | (2006.01) |

(52) U.S. Cl.

CPC ..... *F04B 49/00* (2013.01); *F04B 23/04* (2013.01); *F04B 23/06* (2013.01); *F04B 49/065* (2013.01); *F04B 49/103* (2013.01); *F04B 2203/0209* (2013.01); *F04B 2205/05* (2013.01)

(58) Field of Classification Search

CPC ..... F04B 49/00; F04B 49/06; F04B 23/04; F04B 23/06; F04B 49/065; F04B 49/103; F04B 203/0209; F04B 2205/05

USPC ..... 417/2, 3, 4, 7, 53, 572; 702/98, 100, 702/182, 183; 700/282

See application file for complete search history.

(56) References Cited

U.S. PATENT DOCUMENTS

| | | | | |
|---|---|---|---|---|
| 4,642,992 | A * | 2/1987 | Julovich | 60/661 |
| 4,805,118 | A * | 2/1989 | Rishel | 702/47 |
| 5,743,715 | A * | 4/1998 | Staroselsky et al. | 417/6 |
| 6,045,331 | A | 4/2000 | Gehm et al. | |
| 7,143,016 | B1 | 11/2006 | Discenzo et al. | |
| 2011/0081255 | A1 | 4/2011 | Steger et al. | |
| 2014/0180485 | A1 * | 6/2014 | Stavale | 700/282 |

OTHER PUBLICATIONS

Finnish Search Report issued on Sep. 7, 2012 for Application No. 20116080.

* cited by examiner

*Primary Examiner* — Devon Kramer
*Assistant Examiner* — Patrick Hamo
(74) *Attorney, Agent, or Firm* — Buchanan Ingersoll & Rooney PC

(57) ABSTRACT

A method and controller for operating pumps wherein each pump is modelled by a QH model indicating a high-efficiency region, a high-H region and a high-Q region and a rotational speed limit. A controller dynamically maintains a current set of operating pumps and controls their rotational speed (n). In steady-state operation, wherein the pumps operate in the high-efficiency region and below the rotational speed limit, all pumps of the current set are controlled together. If the pumps operate in the high-Q region or beyond the speed limit, a new pump is added to the current set, started and brought to a speed that produces flow. A balancing operation (12-3) follows the pump addition operation, wherein the speed of the pumps of the current set are adjusted for equal heads. If the pumps operate in the high-H region, a pump is removed from the current set of pumps.

12 Claims, 11 Drawing Sheets

(A)

(B)

(A)

(B)

(A)

(B)

(A)

(B)

(A)

(B)

(A)

(B)

METHOD AND CONTROLLER FOR OPERATING A PUMP SYSTEM

RELATED APPLICATION

The present application claims priority from Finnish patent application FI20116080, filed Nov. 2, 2011, the entire contents of which is incorporated herein by reference.

FIELD

The disclosure relates to a pump system wherein several pumps can operate in parallel under a common controller.

BACKGROUND INFORMATION

Pumps are used in industrial and service sector applications. They can consume approximately 10-40% of electricity in these sectors. Pumping systems have potential for energy efficiency improvements. Pressure for energy efficiency improvements has led to an increasing number of variable-speed drives (VSDs) in pumping applications, because variable-speed pumping can be an effective way to reduce the total pumping costs, for example, in systems that use a wide range of flow. Pumping systems with a widely varying flow rate demand can be implemented using parallel-connected pumps. There are several control methods available for operating the parallel-connected pumps. In a simple case, parallel-connected pumps can be operated with an on-off control method, where additional parallel pumps can be started and stopped according to the desired flow rate. In systems of a more continuous flow, where precise flow regulation is used, flow adjustment can be carried out by applying throttle or speed control for a single pump, while other pumps can be controlled with the on-off method.

Compared with known rotation speed control, wherein the speed of only one pump is controlled at a time, a higher energy efficiency can be achieved if all parallel-connected pumps are speed regulated. This can be achieved if an additional parallel pump is started before the running pump reaches its nominal speed and the speeds of the parallel pumps are balanced. Starting an additional pump can increase the instantaneous power consumption of the parallel pumping system. However, using additional pumps with a lowered rotation speed can turn into an advantage if the power consumption per pumped volume (specific energy consumption) is smaller compared with a case when the same flow is delivered using only a single pump with a higher pump speed. The amount of saved energy can depend on the characteristics of the parallel pumps and the surrounding system. Realizing these potential energy savings involves advantageous starting and stopping rules for parallel-connected pumps that should be determined in the control procedure.

Energy optimization of parallel-connected, speed-regulated pumps has been studied to some extent and the results have shown that there can be an energy saving potential in the sector of parallel pumping. In order to gain energy savings, optimal speed for parallel pumps can be predicted using a mathematical-optimization-based tool suitable for programmed logic controllers. However, the suggested optimized control method uses adequate information from the system curve including start-up field measurements using pressure sensors and flow meters. On the other hand, there are applications that can determine the flow rate of each parallel pump by applying the monitoring features of the VSDs without separate flow meters. Methods that use the characteristic curves of the pumps as a model and measure pressure and/or power of the pump to determine its operating point are called model-based methods. Some model-based methods are well known in the industry. Because energy improvements in parallel pumping are welcome but sufficient initial data from continuously changing systems are often available only to a limited extent, it is justified to study if existing pumping process monitoring solutions could be used for advanced control purposes.

Because known pump control techniques can involve detailed system information, separate flow metering devices and/or start-up measurements, which may have to be repeated if the system conditions change, more versatile parallel pumping control methods are disclosed herein to, for example, improve parallel pumping processes with respect to energy efficiency, reliability or both.

SUMMARY

A method is disclosed for operating a plurality of pumps with a controller, wherein each pump is modelled by a flow-head model ("QH model"), that indicates a predefined high-efficiency region, a high-H region wherein the head is higher than in the high-efficiency region and a high-Q region wherein the flow is higher than in the high-efficiency region, the QH model indicating a rotational speed limit, the method comprising dynamically maintaining a current set of operating pumps from among the plurality of pumps, and controlling rotational speed of each pump in the current set of operating pumps, wherein the dynamically maintaining and controlling of rotational speed includes a steady-state operation wherein all pumps of the current set of operating pumps are controlled together, so long as the pumps of the current set of operating pumps operate in the high-efficiency region and do not exceed the rotational speed limit, a pump addition operation, responsive to detected operation in the high-Q region or beyond the rotational speed limit, wherein a new pump is started and brought to a rotational speed that produces flow and is added to the current set of operating pumps, a first balancing operation, following the pump addition operation, wherein the rotational speeds of the pumps of the current set of operating pumps are adjusted for equal heads, and a pump removal operation, responsive to detected operation in the high-H region, wherein the current set of operating pumps is decreased by at least one pump.

A controller is disclosed for controlling a pump system having a plurality of pumps, the controller comprising a memory that stores, for each of the plurality of pumps, a flow-head model ("QH model"), that indicates a predefined high-efficiency region, a high-H region wherein a head is higher than in the high-efficiency region, and a high-Q region wherein flow is higher than in the high-efficiency region, the QH model indicating a rotational speed limit and a processor configured to dynamically maintain a current set of operating pumps from among the plurality of pumps and to control rotational speeds of the current set of operating pumps, wherein the controller for dynamically maintaining and controlling rotational speed is configured to perform the following operations, a steady-state operation wherein all pumps of the current set of operating pumps will be controlled together, so long as the pumps of the current set of operating pumps operate in the high-efficiency region and do not exceed the rotational speed limit, a pump addition operation, responsive to detected operation in the high-Q region or beyond the rotational speed limit, whereby a new pump is started and brought to a rotational speed that will produce flow and is added to the current set of operating pumps, a first balancing operation, following the pump addition operation, wherein the rotational speed of the pumps of the current set of operating pumps will be adjusted for equal heads and a pump removal operation, responsive to a detected operation in the high-H region, wherein the current set of operating pumps will be decreased by at least one pump.

BRIEF DESCRIPTION OF THE DRAWINGS

In the following the disclosure will be described in greater detail by specific exemplary embodiments with reference to the attached drawings, in which.

DETAILED DESCRIPTION

Exemplary embodiments of the present disclosure provide a method, a controller for a pump system, and a pump system, that can provide improvements with regard to energy efficiency, reliability or both.

Exemplary embodiments of the present disclosure relate to a dynamic speed control method for parallel-connected centrifugal pumps (later referred to as parallel pumps), which can improve the pumping energy efficiency compared with known rotation speed control of parallel pumps. As used herein, "dynamic speed control" refers to a technique that utilizes continuous flow metering for each of the parallel pumps. Those skilled in the art will understand that "continuous flow metering" means techniques wherein any external observer perceives the flow metering as continuous. This means that flow metering is interrupted either not at all or at most for periods shorter than the intended response time of the control system and method. The method can be applied, for example, with parallel pumps located in water stations, waste water pumping stations, and industrial plants, where precise flow adjusting is needed. The method aims to obtain the introduced dynamic flow adjustment, even if the pumping system characteristics are changing. The proposed speed control method can enable better energy efficiency compared with the known speed control especially in existing parallel pumping systems with a continuous flow need, relatively flat system curve, and when the pumping systems are dimensioned according to the highest flow rate. Contrary to the existing optimized rotation speed control methods, the introduced control can be utilized without separate flow meters or detailed system data.

Exemplary embodiments of the disclosure include a method, a controller and a pump system. Those skilled in the art will realize that in connection with exemplary embodiments involving variable-frequency controllers (or drives), the controller (or control function) can be integrated in one or more of the variable-frequency controllers.

Figure 1:
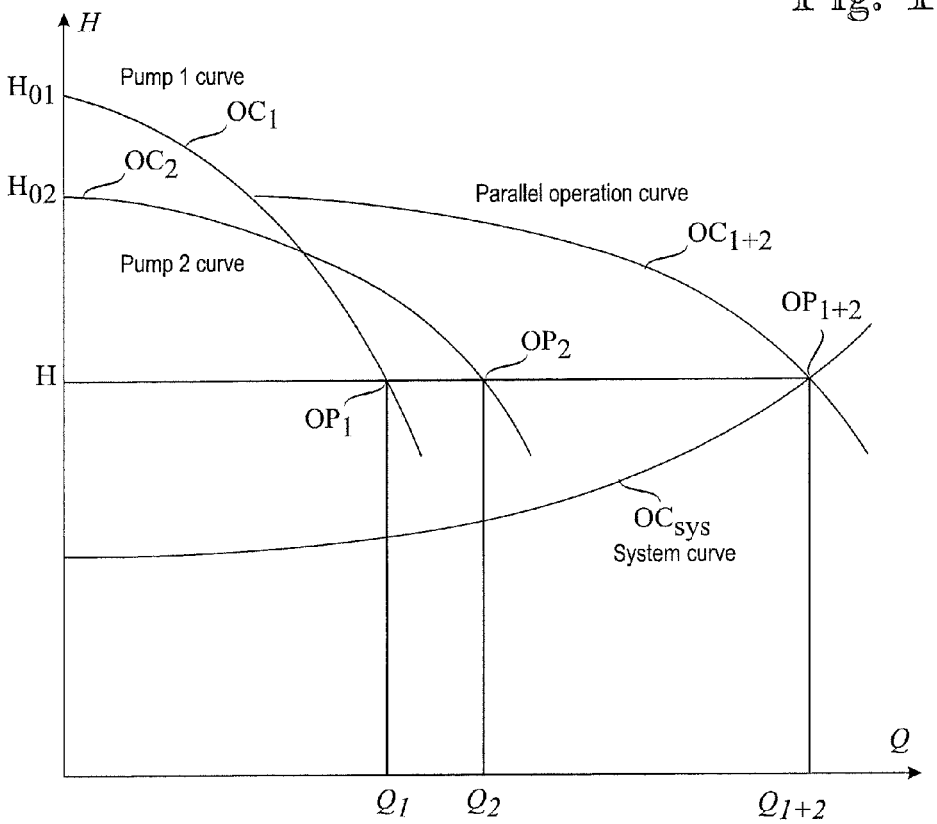
FIG. 1 shows parallel operation of two pumps and a resulting operating point location with the total flow rate.

FIG. 1 illustrates operation curves for two pumps, called M1 and M2. (The letter 'M' stands for Motor, which is the component of the pump actually being controlled, and the lowercase p is reserved for pressure.) Reference signs $OC_1$ and $OC_2$ denote the operation curves for the two pumps M1 and M2. Reference sign $OC_{1+2}$ denotes the operation curve for parallel operation of the two pumps, and reference sign $OC_{sys}$ denotes the system curve, i.e., the interdependency of head and flow in the system. Reference signs $H_{01}$ and $H_{02}$ denote, respectively, the heads of the pumps M1 and M2 at zero flow. The system involving the two pumps M1 and M2 in parallel can operate at an operating point denoted by reference sign $OP_{1+2}$, whose head and total flow are denoted by reference signs H and $Q_{1+2}$, respectively. $Q_1$ and $Q_2$ denote the flows of the individual pumps M1 and M2 when the combined system is operating at the operating point $OP_{1+2}$.

The use of two or more centrifugal pumps in parallel allows production of a wider range of flow rates than would be possible with a single pump. In other words, parallel connection of centrifugal pumps can increase the flow rate capacity of a pumping system.

A parallel-connected pumping system can provide the sum flow rate $Q_1+Q_2$ of the two pumps M1 and M2 with a common amount of head, denoted by H. The operating point $OP_{1+2}$ of this parallel-connected pumping system can be located at the intersection of the system curve $OC_{sys}$ and the parallel operation curve $OC_{1+2}$, the latter being the sum of the individual characteristic curves of the pumps M1 and M2. Individual operating point locations $OP_1$ and $OP_2$ of the respective pumps M1 and M2 can be determined by the respective flow rates $Q_1$ and $Q_2$.

Figure 2:
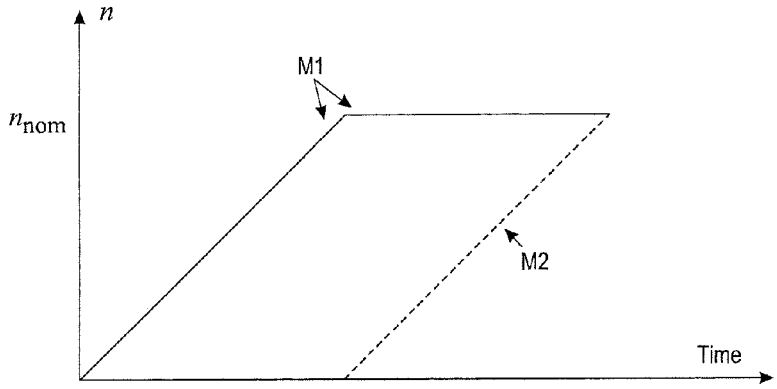
FIG. 2 shows known rotation speed control of two parallel-connected pumps as a function of total flow rate.

Parallel-connected centrifugal pumps can be controlled, for example, with ON-OFF, throttle, and speed control methods. The use of the ON-OFF method is justified for applications having a tank or a reservoir and no need for accurate control of the flow rate. Correspondingly, the throttle control method can be used to regulate the flow rate produced by the pump but because of its relatively poor energy efficiency, it is rarely justified. Speed control, on the other hand, can allow the flow rate control with a lower energy use compared with the throttling method. The basic version of speed control for parallel-connected pumps, a known rotation speed control method, is based on the adjustment of the rotation speed of only a single pump at a time. This is illustrated in FIG. 2 for two parallel-connected centrifugal pumps. At low flow rates, only the primary pump M1 is used, and the secondary pump M2 is started when the primary pump M1 has reached its nominal speed and still more flow rate is required.

FIG. 2 illustrates a known rotation speed control of two parallel-connected pumps as a function of total flow rate. In the diagram, the required flow increases with increasing time. When the primary pump M1 reaches its nominal speed, more flow is delivered by starting the secondary pump M2 in parallel with the primary pump M1.

A higher energy efficiency compared with the known rotation speed control can be achieved if the speeds of both pumps operating in parallel are controlled dynamically. In the context of the present disclosure "dynamic speed control" refers to a technique in which the speeds of several pumps operating in parallel are controlled with a better resolution than in the traditional ON-OFF or throttle techniques, and a continuously variable speed control is utilized, by variable-frequency converters, for example.

In addition to saving energy, the use of dynamic speed control in multiple pumps operating in parallel can provide an opportunity to avoid situations where parallel pumps are operating at or near shut-off or in a region where the service life of the pump may be affected by flow recirculation, high flow cavitation, and/or shaft deflection. An example of a desirable option compared with the known speed control can be demonstrated by observing the operation of two identical raw water pumps, e.g. Ahlstrom P-X80X-1, in a system with a static head of 15 m. In this example, the system curve is chosen such that both pumps can have a high pumping efficiency when they are operated at the nominal speed.

Figure 3:
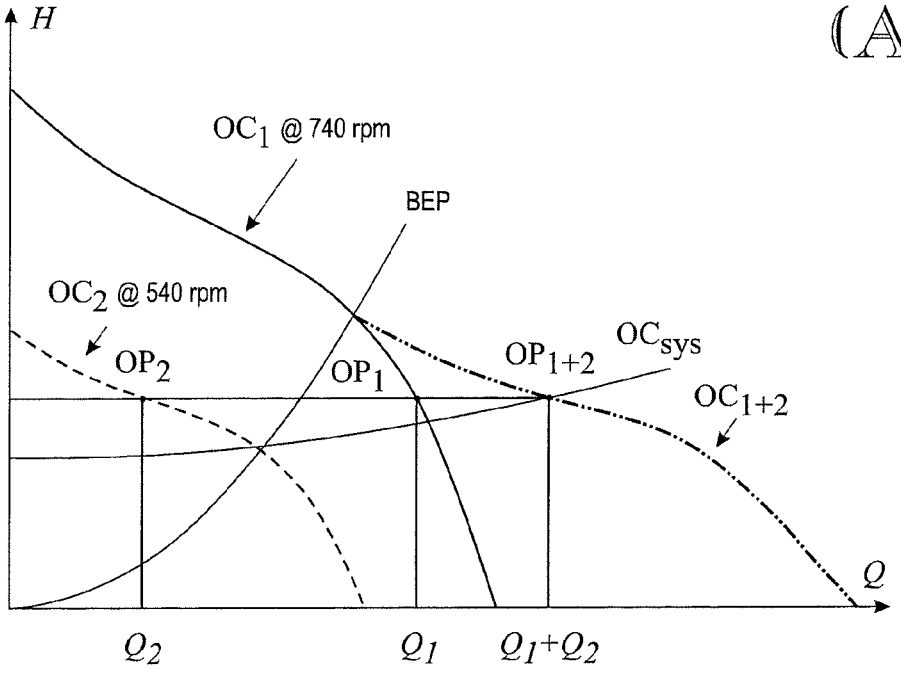
FIGS. 3(A) and 3(B) show a comparison of speed-regulated parallel pumping using the known rotation speed control and a speed control according to an exemplary embodiment of the disclosure, wherein both pumps are running at a speed less than nominal speed.
Figure 3:
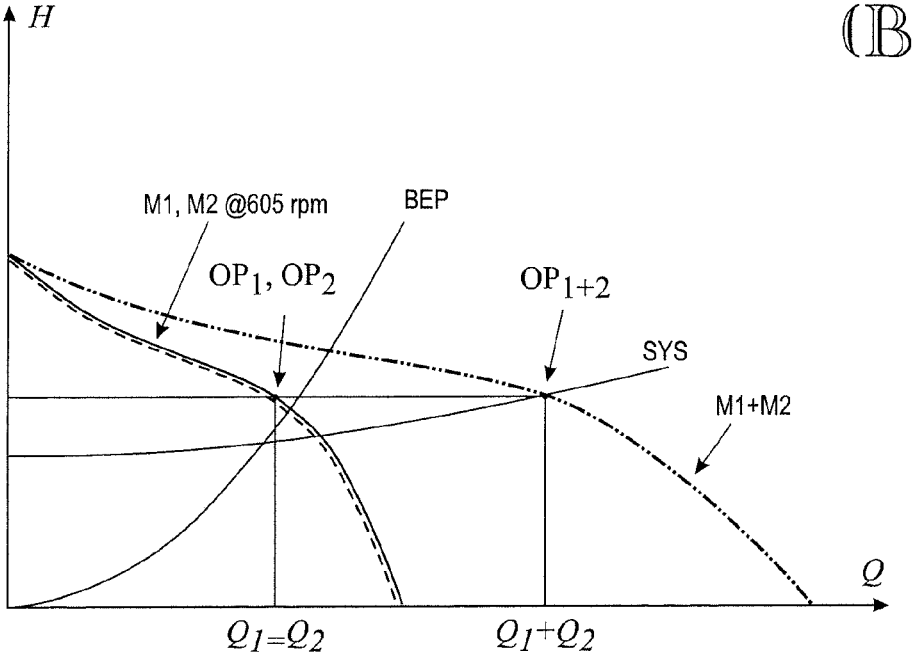

FIGS. 3(A) and 3(B) illustrate speed-regulated parallel pumping using, respectively, the known rotation speed control and a speed control according to an exemplary embodiment of the disclosure, wherein both pumps are running at a speed lower than their nominal speed.

FIG. 3(A) plots the QH curves of the parallel pumps: the first pump M1 operating at the nominal 740 rpm speed and the second pump at a 540 rpm speed, the system curve, and the combined parallel pump curve M1+M2. FIG. 3(B) shows the QH curves when both pumps are operating at less than their nominal speed (605 rpm in the illustrated example). The pumps operating in parallel deliver the same total flow $Q_1+Q_2$. In the known speed control, it is quite common that the operating points $OP_1$ and $OP_2$ of the parallel pumps are far from the best efficiency point, denoted by reference sign BEP. In FIG. 3(B) the BEP curve shows the location of the best efficiency point in pump QH-curve in different speeds using affinity laws. The BEP curve thus represents the optimal operating region at different pump speeds rather than just a singular location of the best pump efficiency. As shown in FIG. 3(B), if the same flow rate is delivered using the dynamic speed control for both pumps, the operation points of the pumps, namely $OP_1$ and $OP_2$, are closer to the BEP curve. Operating the pumps at or near their best efficiency points provides certain benefits, such as a higher energy efficiency and/or mechanical reliability. For best results, all pumps should be speed regulated.

Because the delivered flow rate is often the control variable in parallel pumping, a justified parameter for evaluating the energy efficiency of pumping is specific energy, which describes the energy used per pumped volume. Specific energy can be given by:

$$E_S = \frac{P_{in} \cdot t}{V} = \frac{P_{in}}{Q} \quad [1]$$

Herein, $E_s$=specific energy (kWh/m$^3$), $P_{in}$=input power to pump drives (kW), t=time (h), V=pumped volume (m$^3$), and Q flow rate (m$^3$/h).

The dynamic control method can deliver the desired flow rate using parallel pumps with a lower total energy consumption compared with the known rotation speed control, and/or to prevent the pumps from operating in regions with a higher risk of mechanical failure. If system conditions do not allow this kind of a operation, or there is no risk of operating in an region that should be avoided, the introduced control can operate similarly to the known control and therefore attain at least the same energy consumption level. The introduced method for the control of parallel-connected pumps was designed based on the following conditions.

A benefit of model-based control techniques is that the control algorithm can operate with relatively little initial information. An accurate model enables operation without installation of additional sensors in the pumping system. Compared with the existing/known control methods, the algorithm should be able to reduce the energy consumption of the pumping system and/or prolong the service life of the pumps, when a certain flow rate is produced with parallel-connected pumps.

The condition to operate on the basis of a minimal amount of information is met by utilizing the model-based pump operation estimation available in a modern VSD. Features such as vibration and input power metering can help to monitor the behavior of the pumping process but these monitoring methods seem not to be reliable enough to be used for flow rate controlling purposes according to findings. Instead, flow metering based on pressure measurements has been shown to give more accurate information on a pump's operating state. Adequate flow metering of individual pumps in the introduced parallel pumping control allows adjusting the pumped volume according to process changes. Therefore, separate and possibly more expensive flow meter installation or start-up field measurements can be unnecessary. In this case, only pressure sensors for inlet and outlet pressure measurements are needed.

Figure 4:
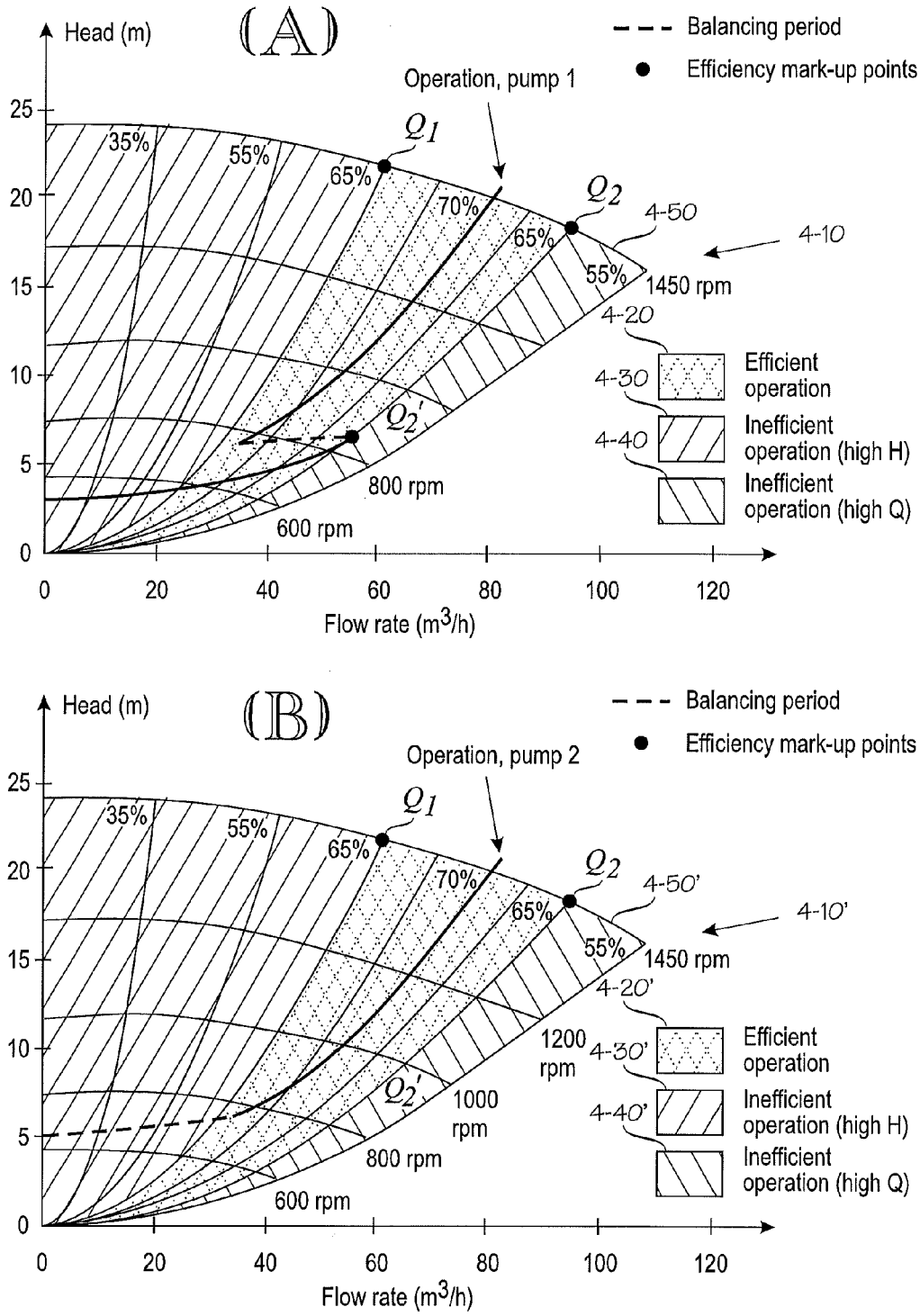
FIGS. 4(A) and 4(B) show the area between the efficiency markups at different pump speeds according to affinity laws.

The parameters relating to higher energy efficiency and/or improved service life can be achieved by determining a preferred operating region in the QH curve for each of the parallel pumps, and by preventing the pumps from operating outside this operating region during speed adjustment, if possible. FIG. 4 illustrates a process which aims at minimizing the operation of pumps outside efficient operating region. In the case of two similar parallel pumps, this means that the rotational speed of the primary pump is not necessarily increased to its nominal value, but instead, at a determined point, the speed of the primary pump is kept constant, while the speed of the second pump is increased in order to produce flow. When the secondary pump has started to produce flow, the speed of the pumps can be balanced to the same pump head value, and in the case of more flow demand, both pumps can be adjusted closer to their nominal speeds. Especially if parallel pumps are dimensioned according to the flow rate at the nominal speed, the balancing procedure should enable lower specific energy consumption compared with the traditional speed control of parallel pumps, and both pumps can be kept closer to each pump's best efficiency area during adjustment.

FIGS. 4(A) and 4(B) plot the area between the efficiency markups at different pump speeds according to the affinity laws. The affinity laws are rules that govern the performance of a centrifugal pump when the speed of the pump is changed. Provided that the performance of the pump is known at any one speed, the affinity laws can predict the performance of the pump at other speeds. The affinity laws permit generating new QH- and QP-curves for pumps running at a speeds different from the speeds at which the pump specifications were published or tested. According to the affinity laws, the relationship between flow rate and pump speed is given by:

$$\frac{Q}{Q_0} = \frac{n}{n_0} \quad [2]$$

Herein, $n_0$=pump speed before speed change and n=pump speed after speed change. The relationship between head and pump speed is:

$$\frac{H}{H_0} = \left(\frac{n}{n_0}\right)^2 \quad [3]$$

The relationship between power and pump speed is given by:

$$\frac{P}{P_0} = \left(\frac{n}{n_0}\right)^3 \quad [4]$$

The flow rate limits, at which balancing the speeds of the parallel pumps should be commenced, can be set by using only the pump characteristics. To select the flow rate limits, the pump efficiency can be seen as a good reference variable for limiting values, because the performance curves of centrifugal pumps usually contain efficiency data. As illustrated in FIGS. 4(A) and 4(B), respectively, balancing the speeds moves the operation point of Pump 1 to a region of higher efficiency, while Pump 2 is being run towards the same head level. The increase in the flow rate of Pump 2 creates friction losses in the piping. This is why the head of Pump 1 does not retrace its course from the origin, while the rotational speed is being decreased. Instead the head of Pump 1 seems to remain constant. Consequently, both pumps are running in a region that can be considered beneficial as regards energy efficiency and reliability. Because the model-based speed control of parallel pumps utilizes continuous flow metering of each individual pump, the control is referred to as dynamic control.

In this section, the suggested model-based rotation speed control of parallel pumps (dynamic control) is compared with the known speed control in operation. The comparison is made using a simulation tool for pumping system observation. The simulated operation is verified by laboratory measurements in a parallel pump setup. Differences between control methods are evaluated in terms of power consumption and specific energy use.

Figure 5:
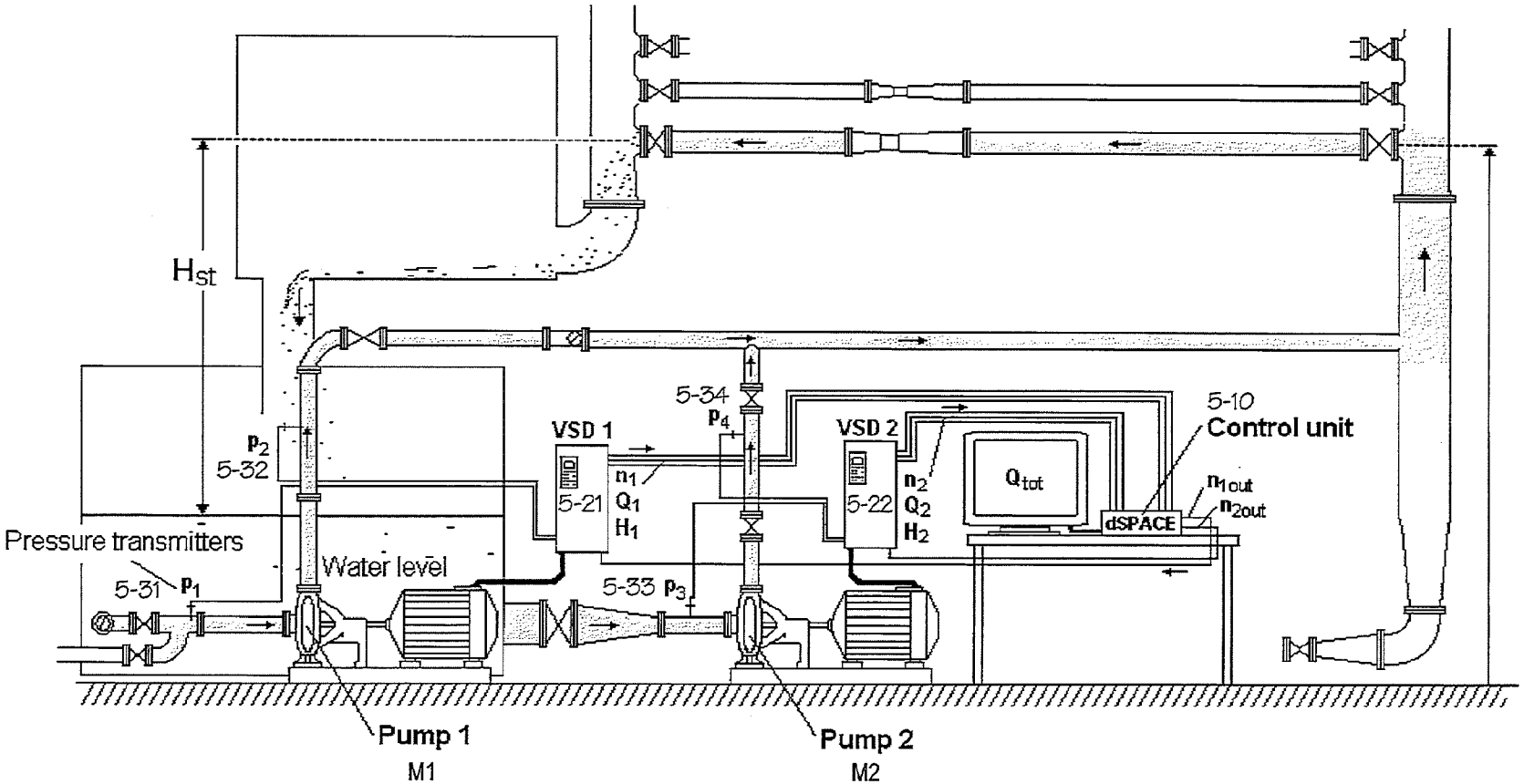
FIG. 5 shows an exemplary laboratory setup involving two different motors operating two different pumps, wherein the motors are supplied from two variable frequency converters controlled by a common (i.e., single) controller having a processor and memory.
Figure 6:
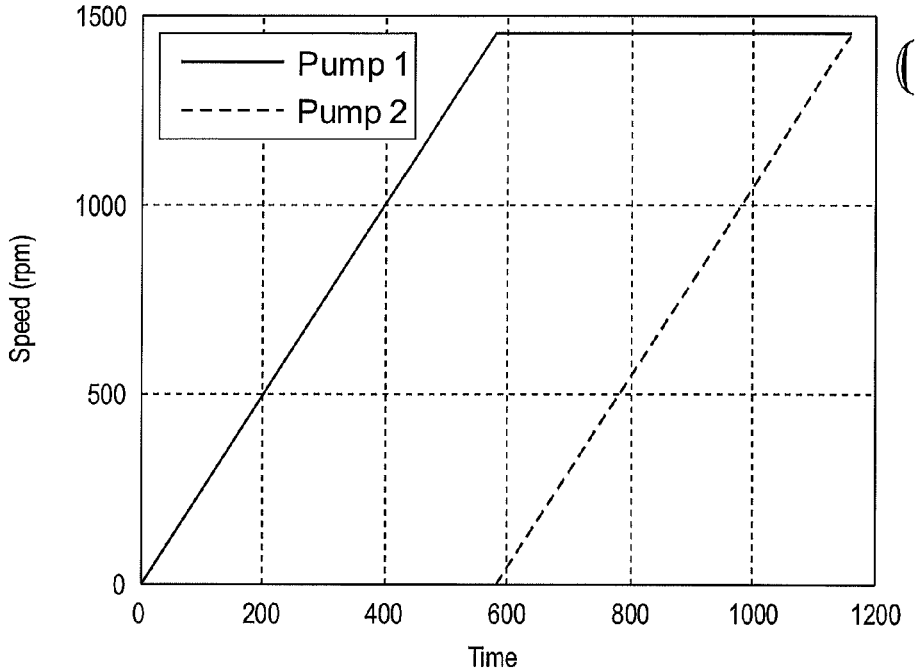
FIGS. 6(A) and 6(B) and 7(A) and 7(B) show simulation results for the laboratory example described in connection with FIG. 5.
Figure 6:
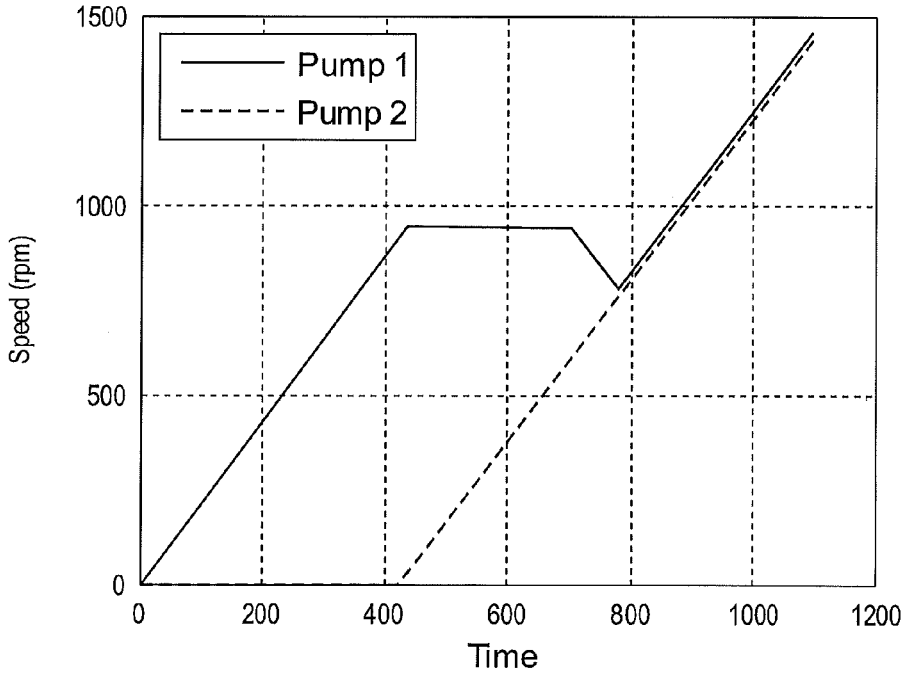
Figure 7:
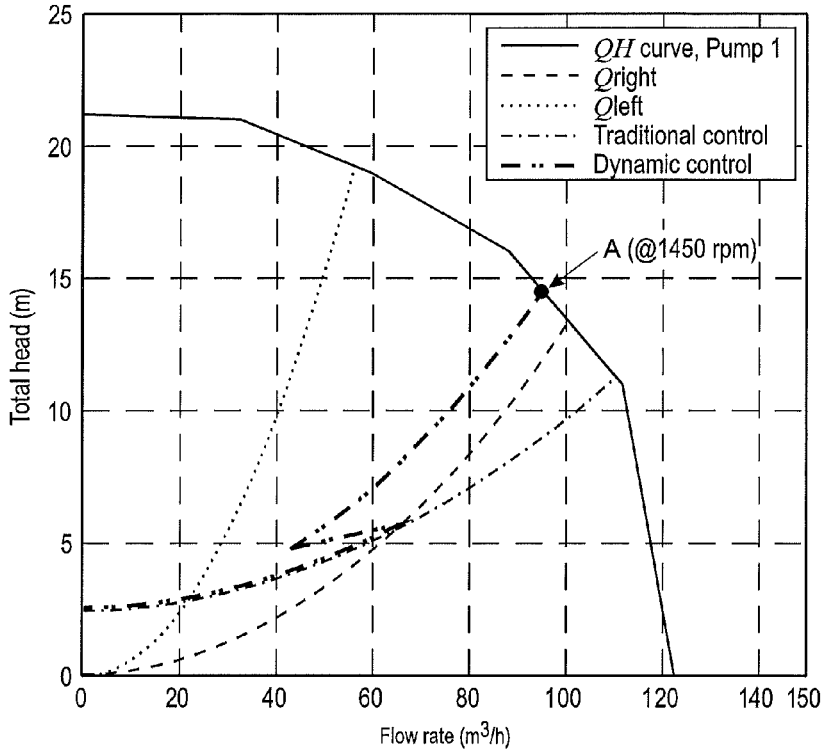
Figure 7:
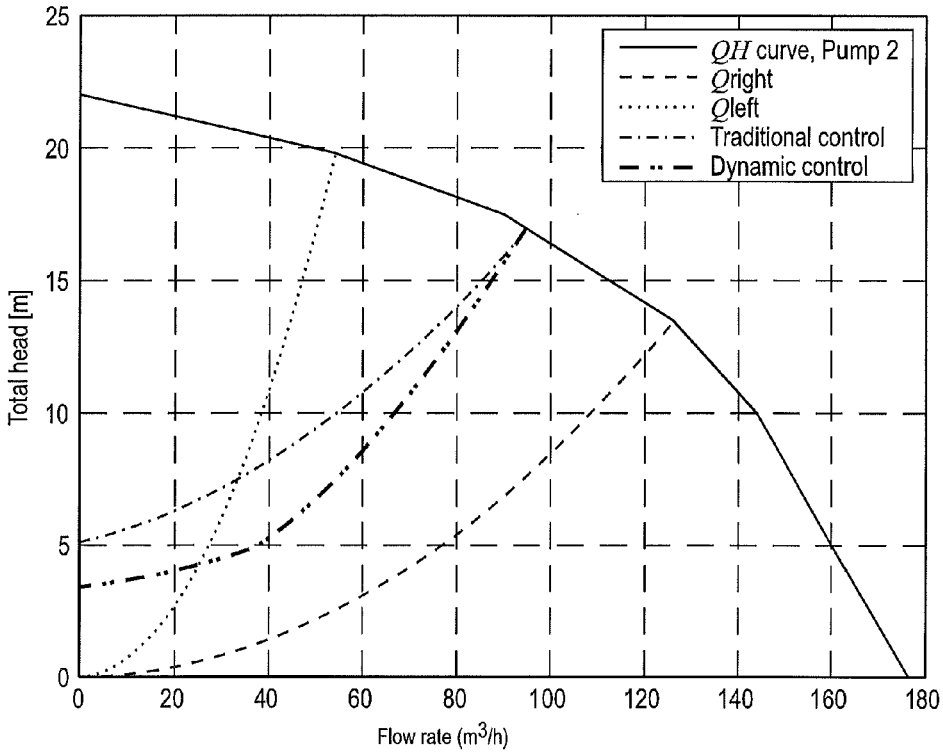
Figure 8:
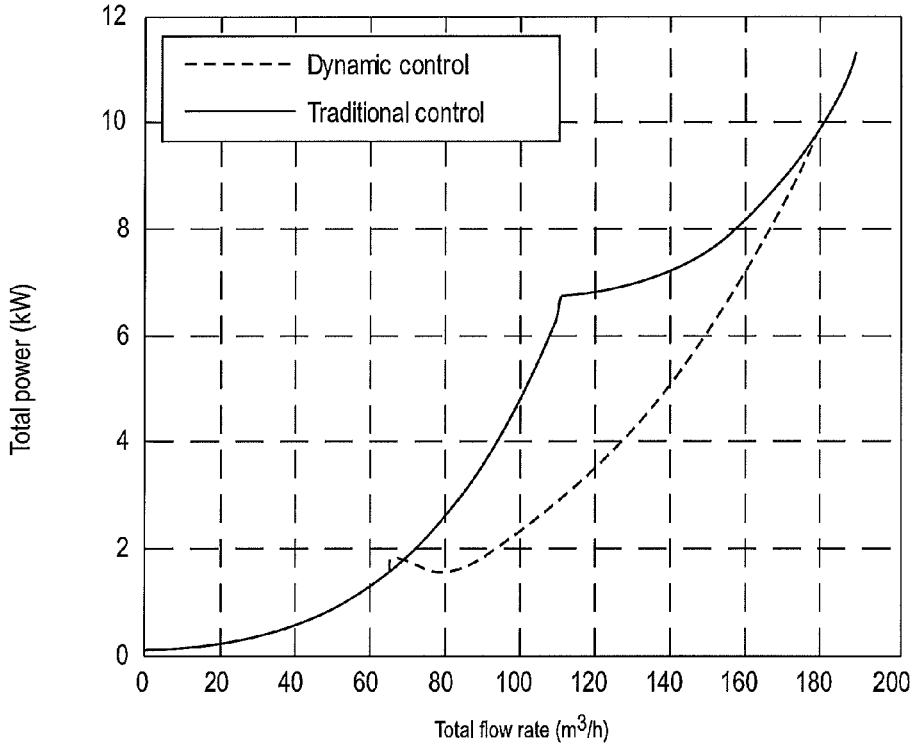
FIGS. 8(A) and 8(B) show a comparison of total power consumption and specific energy consumption between a pump control technique and a control technique according to an exemplary embodiment of the disclosure.
Figure 8:
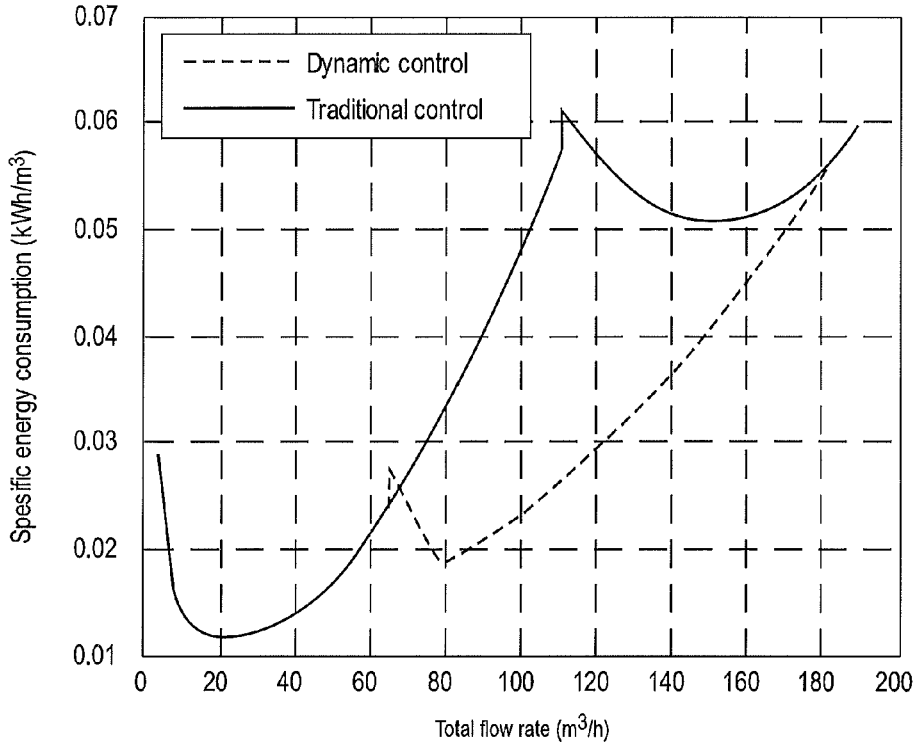
Figure 9:
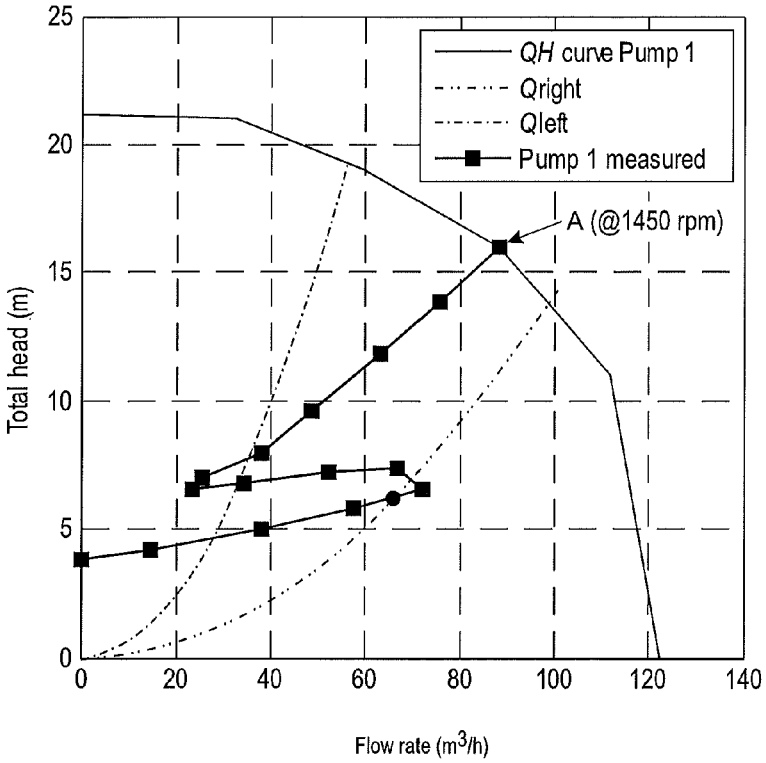
FIGS. 9(A) and 9(B) show actual measurement results obtained from the system described in connection with FIG. 5.
Figure 9:
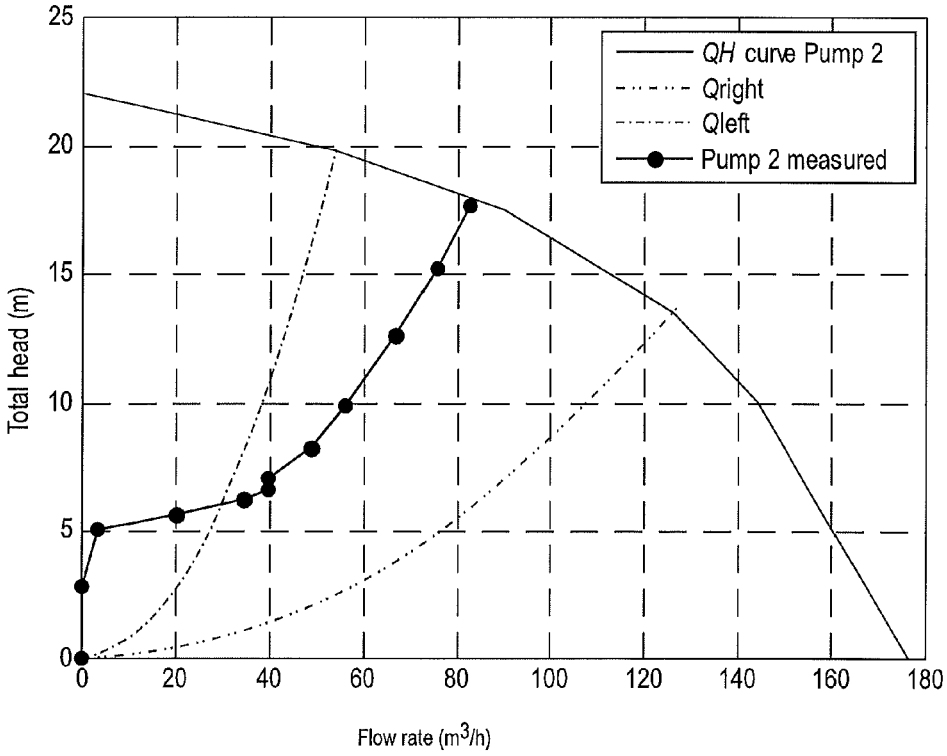
Figure 10:
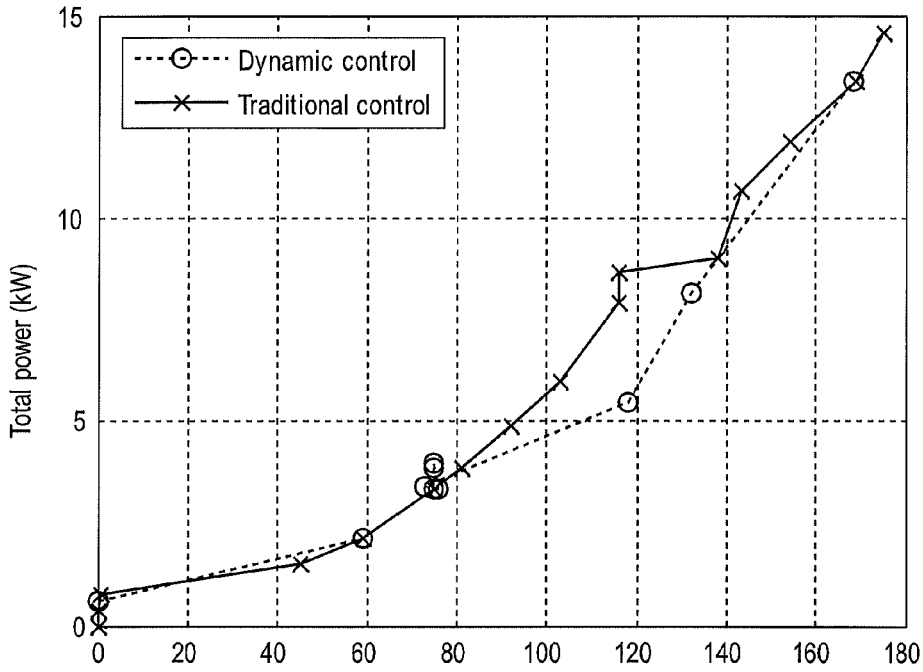
FIGS. 10(A) and 10(B) show a comparison of estimated total input power of both drive trains between a known pump control technique and a control technique according to an exemplary embodiment of the disclosure.
Figure 10:
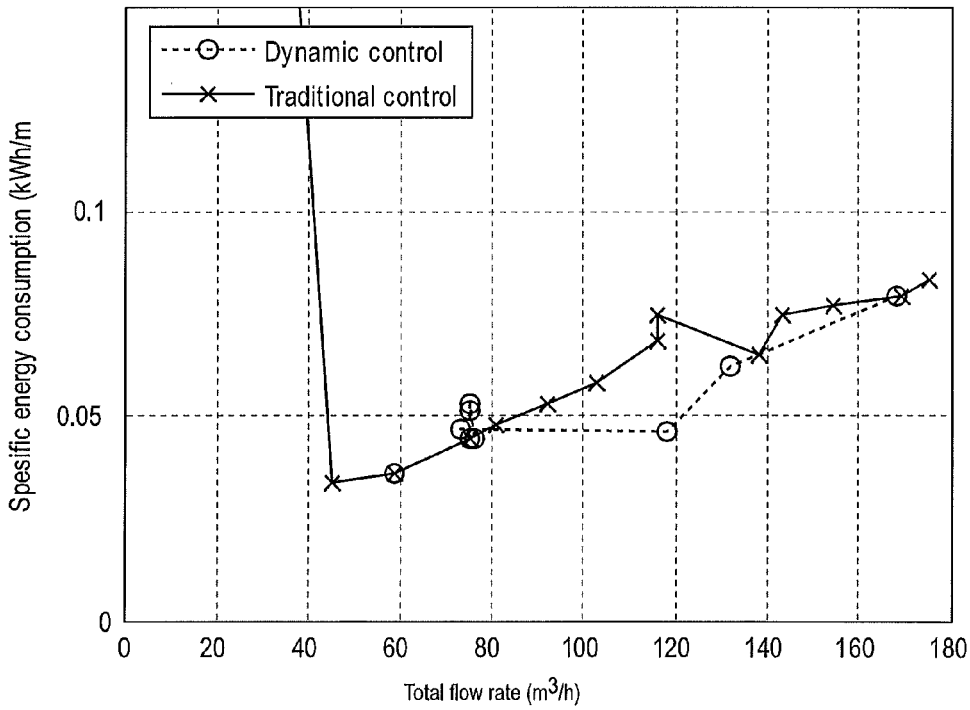

Referring to FIG. 5, an exemplary laboratory setup will be described. The laboratory setup being described in detail herein utilizes two pumps, which are referenced by their motors M1, M2. Those skilled in the art will understand that the number of pumps is purely arbitrary and various exemplary embodiments of the disclosure are applicable to a higher number of pumps. In principle, the pumps, motors and frequency converters may be similar or different, but the specific laboratory setup whose simulation and measurement results will be described in connection with FIGS. 6 through 10, utilizes two different pumps, with two different motors, while the frequency converters, denoted by reference numbers 5-21 and 5-22, are similar. The pumps are connected in parallel on their hydraulic side. The laboratory example contains two pump trains, both of them include a single-stage centrifugal pump, and a variable speed drive VSD1, VSD2 connected to a three-phase motor M1, M2. The primary pump train, including pump M1, can include, for example, a Serlachius DC 80/255 centrifugal pump, a four-pole 15 kW Strömberg induction motor, and an ABB ACS 800 frequency converter. The secondary pump train, including Pump 2, can include, for example, a Sulzer APP 22-80 centrifugal pump, an ABB 11 kW induction motor, and an ABB ACS 800 frequency converter. Both VSDs estimate the individual flow rates using pump head measurement. The total flow rate is also measured using a Venturi tube. These implementation details are not intended to restrict the disclosure per se but the details are relevant for the simulation and measurement results that will be described in connection with FIGS. 6 through 10.

A control algorithm according to an exemplary embodiment of the present disclosure can be implemented, for example, in a dSPACE DS1103 PPC controller board. The dSPACE board has analogue voltage inputs and outputs, and they can be read and controlled using a Matlab® Simulink® model. The inputs for the controller board are the rotational speeds n1, n2, heads H1, H2, and flow rates Q1, Q2 of the individual pumps M1, M2, plus the total flow rate Q1+Q2. The outputs of the controller board are the rotational speed references n1out, n2out, for the individual pumps M1, M2. In the laboratory measurements, the flow rate is controlled based on the requirement for more flow, less flow, or no change in the flow rate. Detailed implementation examples for the controller will be discussed in connection with FIGS. 11 and 12.

Those skilled in the art will understand that the functionality of the common controller can be integrated into the software portion of either or both of the variable-frequency controllers 5-21, 5-22.

The static head of the piping system is 2.5 meters, and the system curve was set using valves so that both pumps would gain reasonable efficiency when operating parallel at their nominal speed. This illustrates a case where a parallel pumping system is dimensioned according to the highest flow rate.

The operation of the presented control methods is simulated for the laboratory pumping system with a Matlab® Simulink® model. The model is constructed to enable energy efficiency calculations of pumping. In the simulation of this study, performance, combined power consumption, and specific energy consumption of two parallel-connected pumps, having the same characteristics as the introduced pumps in the laboratory setup, are evaluated in a case where total the flow of the pumping system is increased using either the traditional speed control or the presented dynamic control.

Referring to FIGS. 6(A), 6(B), 7(A) and 7(B), simulation results for the laboratory example described above will be described next. A simulation was conducted from flow rates 0 to 189 m3/h. The rotational speeds of the individual pumps using both control methods during a simulation sequence (0-1200 s) are given in FIG. 6.

As shown in FIG. 6(A), in the known control the rotational speed of the primary pump M1 is increased to 1450 rpm, after which the secondary pump M2 is started and run towards its nominal speed. In contrast, FIG. 6(B) shows results obtained from the dynamic control technique according to an exemplary embodiment of the present disclosure. In the dynamic control technique the secondary pump M2 is started before the primary pump M1 reaches its nominal speed. As stated earlier, the key issue is not necessarily operating near the nominal speed of the pump or far from it, but operating within or outside of the pump's region of efficient operation. In the exemplary embodiment described herein, the primary pump M1 reaches the set flow limit as described previously. This means that in the technique of FIG. 6(B), when the secondary pump is started, the difference between flow rates of the two pumps is lower than in the traditional control scheme depicted in FIG. 6(A).

FIGS. 7(A) and 7(B) illustrate simulated operation points for two parallel-connected pumps using the traditional or dynamic control, respectively. FIGS. 7(A) and 7(B) also show the chosen flow rate limits for the dynamic control algorithm based on the pump data given by the manufacturers of the pumps.

It can be seen from FIGS. 7(A) and 7(B) that even though traditionally controlled parallel pumps are operating in the same operation point as in the dynamic control when both pumps have reached their nominal speed (1450 rpm in the present example), the dynamic control enables continuous operation between the set flow rate limits, such that the operating point remains in the efficient operating range of the pumps. Therefore the operating points, especially in the case of M1 (~65-90 $m^3$/h), are located in a region of better efficiency compared with the traditional speed control. Because of the balancing, the operating point of the secondary pump M2 is only temporarily located in an undesirable region, and steady-state operation after the balancing period (at ~40-90 $m^3$/h) takes place between the set limits. During the balancing period, the primary pump M1 can deliver flow and head, and hence, the secondary pump M2 can generate flow rate only when it has exceeded the required head (~4 m). However, the required head for the secondary pump M2 can be smaller than the total head for the primary pump M1, because the friction-induced portions of the head values for the pumps are not necessarily equal during the adjustment.

FIGS. 8(A) and 8(B) are based on the same simulation results as in FIGS. 6(A), 6(B), 7(A) and 7(B) but observed variables are total power consumption and specific energy consumption. As shown in FIGS. 8(A) and 8(B), benefits of the dynamic control can be seen by observing the total power consumption and the specific energy consumption of both parallel pumps in the same simulation. FIGS. 8(A) and 8(B) plot, respectively, the simulated total pump power and total specific energy consumption for the two parallel pumps, as a function of the total flow. The results suggest that in this particular case, the dynamic control enables lower power consumption and specific energy consumption in the flow range of 70-175 $m^3$/h compared with the known control.

Referring now to FIGS. 9(A) and 9(B), actual measurement results will be described next. The dynamic control behavior in an actual pumping setup was tested in measuring sequences where the flow rate was increased using speed regulation of parallel pumps. The total flow of both pumps varied from 0 to 175 $m^3$/h and back to 0 during the sequences. The measured operation points of each pump represent the average values gathered manually from the data control unit and the measuring equipment.

FIG. 9(A) shows the measured operation points of the primary parallel pump M1 when the total flow of the system is increased from 0 to 175 $m^3$/h. The balancing of the primary Pump M1 starts when the flow rate reaches the set markup line (QRight). FIG. 9(B) shows the operation points for the secondary Pump M2. FIGS. 9(A) and 9(B) show that the dynamic control is guiding the parallel pumps in close conformance with the predictions provided by the simulations. Because the laboratory equipment used in this study does not include measurement of the shaft power of the pumps, only the consumed total input power during parallel pumping was estimated using the input power reference of the variable-speed drives. The results of the estimated total input power of both drive trains during the traditional and dynamic control measurement sequences are illustrated in FIGS. 10(A) and 10(B). FIGS. 10(A) and 10(B) show that in contrast to simulations, the measured total flow rate does not appear to be increasing during the balancing period (~75 $m^3$/h). Despite this, an advantage of dynamic control compared with known control can be seen in total power consumption and in specific energy use.

Even though the estimated total input power rates during different control schemes are directly not comparable with the simulated pump shaft power values, the measured results generally agree with the simulations. The results suggest that the dynamic control reduces the combined input power consumption and the specific energy use over a significant portion of the operating range of the pump system, which in the illustrated working example was between flow rates 80 and 160 $m^3$/h.

Figure 11:
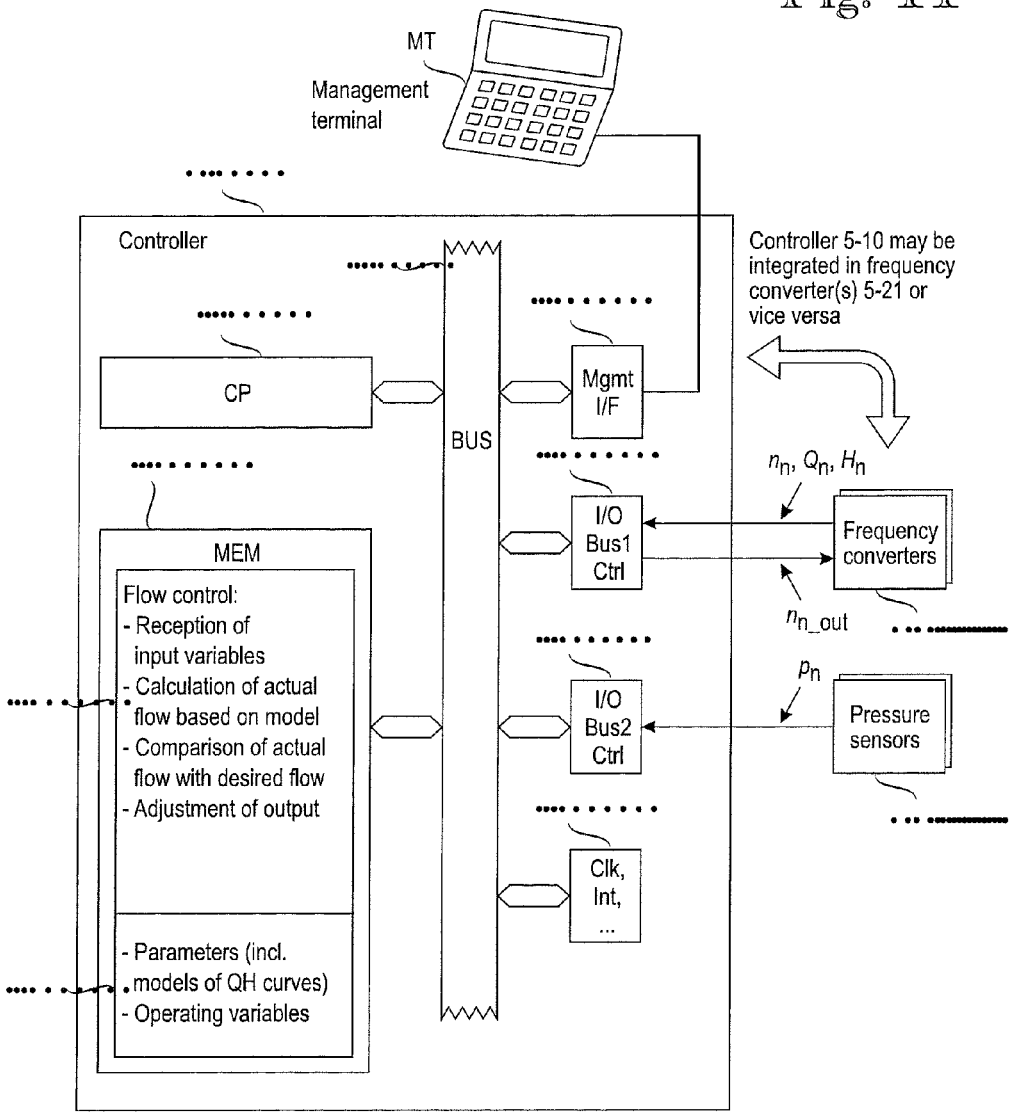
FIG. 11 is a block diagram of an exemplary controller implemented as a programmed data processor with memory.

FIG. 11 is a block diagram of an exemplary controller 5-10 implemented as a programmed data processor with memory. The controller 5-10 was mentioned in connection with FIG. 5, albeit without implementation details. Specifically, FIG. 11 shows a block diagram of the controller's architecture, while a block diagram for an exemplary control process will be discussed in connection with FIG. 12. It should be understood that FIG. 11 shows an exemplary but non-restrictive construction and many other implementations are possible.

As shown in FIG. 11, the controller 5-10 include, a central processing unit (processor) 11-10; an internal bus 11-15, including address, data and control portions; an optional management interface 11-20; two (in the present example) Input-Output bus controllers 11-30, 11-35; circuitry for clock and interrupt functions and related tasks, generally denoted by reference numeral 11-50; and memory, generally denoted by reference numeral 11-50.

By the optional management interface 11-20, the automated controller 160 can communicate with an optional management terminal MT. Such communication can include outputting of statistics and/or inputting of configuration changes, for example. The first Input-Output bus controller 11-30 provides communication capabilities with the variable speed drives VSD1, VSD2, such as frequency controllers (items 5-21, 5-22 in FIG. 5), while the second Input-Output bus controller 11-35 provides communication capabilities with the two pairs of pressure sensors 5-31, 5-32 and 5-33, 5-34 that supply input and output pressure signals p1, p2; p3, p4 in respect of the two pumps M1, M2. It should be self-evident to those skilled in the art that the number of pumps, such as two in the present example, is purely arbitrary, and exemplary embodiments of the disclosure can be generalized to a higher number of pumps, variable speed drives and pairs of pressure sensors.

The memory 11-50 includes a program code portion 11-60 and a data portion 11-80. The program code portion 11-60, when executed by the processor 11-10, performs flow control, by outputting adjustment instructions to the variable speed drives, such as the frequency converters 5-21, 5-22. As a result, the first frequency converters 5-21, 5-22 adjust the supplied energy feed to the pumps M1, M2, thus affecting their rotational speeds n1, n2 and flows Q1, Q2.

Adjustment of the frequency converters 5-21, 5-22 is based on a comparison between desired process values and actual process values, as reported by the frequency converters 5-21, 5-22 and pressure sensors 5-31, 5-32 and 5-33, 5-34. Data models for the pumps M1, M2, such as models for the QH curves of the pumps and the overall system curve, are stored in the data memory portion 11-80. Generation of the adjustment instructions to the frequency converters 5-21, 5-22 as a result of the comparison between desired and actual process values can be adjusted externally, such as from the optional management terminal MT via the management interface 11-20. For the optional management functions, the memory 11-50 includes an optional management program, which is not shown separately.

The optional management interface 11-20 can be any interface that permits a data processing apparatus to communicate with a user terminal, including but not limited to: wired interfaces, such as Ethernet, RS-232, USB, or wireless interfaces, such as Bluetooth, WLAN, infrared, or a connection via a cellular network. As regards the Input-Output buses 1 and 2, they can be implemented by any industry-standard or proprietary technology.

In addition to the program code portion 11-60, the memory of the 11-50 of the controller 5-10 includes a parameter portion 11-80, which contains an electronic model or representation of the QH operating curves of the pumps, or more specifically, pump trains each of which includes a motor-driven pump and a variable-frequency converter. At this point, a reference to FIG. 4 is made to describe the model of the QH operating curves. As shown in FIG. 4(A), the QH curve, denoted by reference numeral 4-10, contains a region of high efficiency, denoted by reference numeral 4-20. In the present example, the high-efficiency region 4-20 is demarcated by the origin (Q=0; H=0), a pair of constant-efficiency lines (65% efficiency in the present example), and a rotational speed (herein, 1450 rpm). Reference numerals 4-30 and 4-40 denote inefficient operating regions respectively located above and below the high-efficiency region 4-20. Operation in the upper inefficient operating region 4-30 is inefficient because of overly high head (high H), while operation in the lower inefficient operating region 4-40 is inefficient because of overly high flow (high Q). Reference numeral 4-50 denotes a predefined limit for the rotational speed, such as the pump's nominal speed $n_{nom}$, which in the present example is set at 1450 rpm.

FIG. 4(B) shows the QH curve model 4-10' for the second pump. The primed reference numerals relate to the second pump. In the present example, the two pumps are similar but the disclosure is not restricted to similar pumps, and the number of pumps, for example two, is purely arbitrary, and exemplary embodiments of the disclosure are applicable to a higher number of pumps.

Based on the present description, those skilled in the art will realize that information technology offers several alternative techniques for modelling the QH curves 4-10. For instance, the QH curves 4-10 can be modelled by discrete-valued tables, wherein Q and H are the input variables and efficiency is the output variable. As can be seen from FIG. 4, limiting the high-efficiency region 4-20 by two constant-efficiency curves (65% efficiency in the present example), provides an elegant manner to test if a pump is operating within the high-efficiency region 4-20. A simple test involves testing if the efficiency is at least 65% and the rotational speed is at most the rotational speed limit 4-50 (1450 rpm in the present example). If both conditions are met, the pump operates in the high-efficiency region 4-20.

In an alternative implementation, the input values of the tables are again Q and H, but the output values of the table are codes that directly indicate the operating region a pump is in. For instance: 1=high-efficiency region, 2=inefficient region (high H), 3=inefficient region (high Q), 4=high-risk region (high n).

Instead of tabulating the efficiency values into a discrete-valued table, the efficiency of a pump train can be modelled by curve-fitting appropriate curves, such as polynomials.

Figure 12:
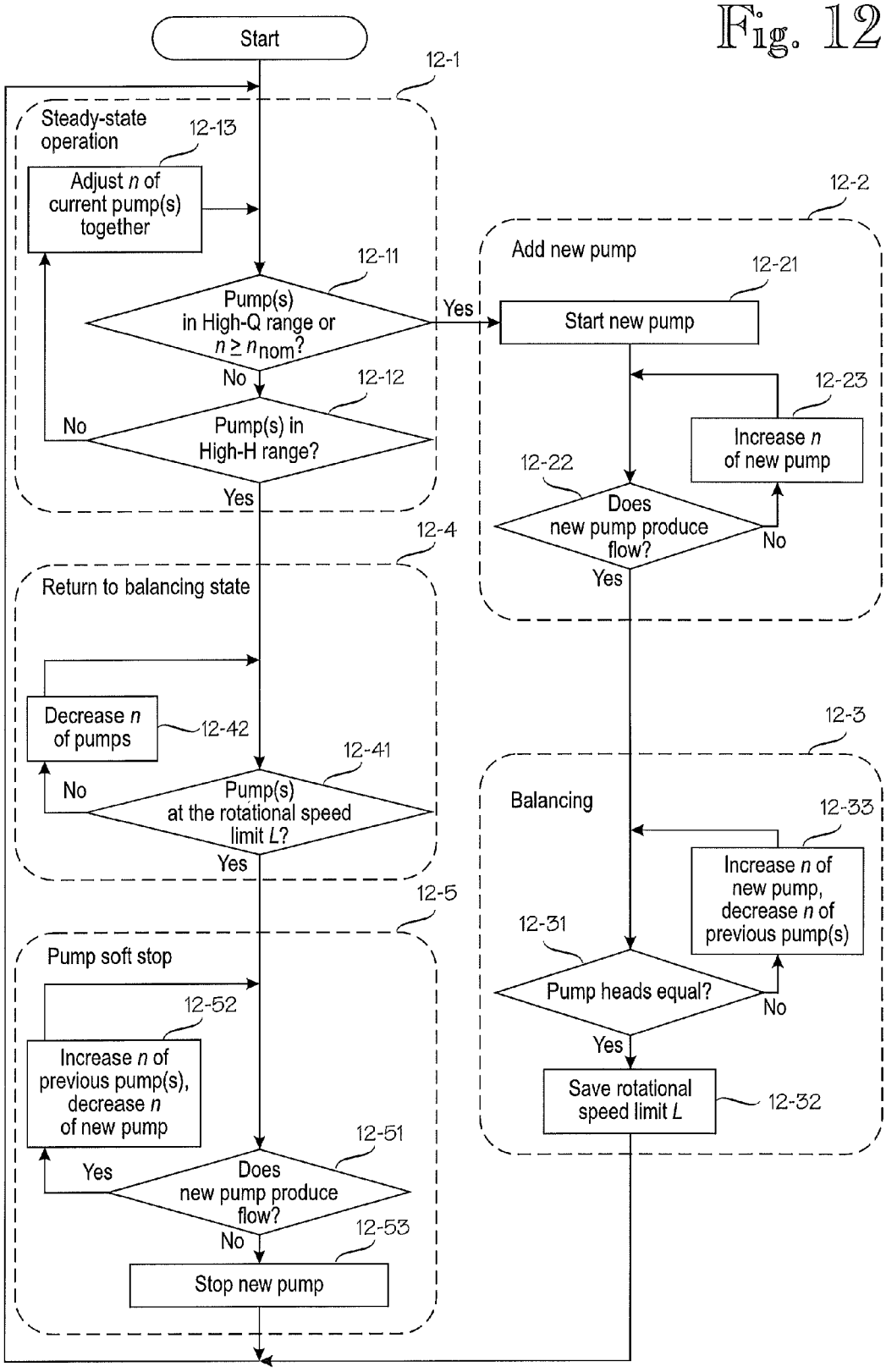
FIG. 12 shows an exemplary flow diagram for a flow control algorithm that can be embedded in the controller shown in FIGS. 5 and 11.

FIG. 12 shows an exemplary flow diagram for a flow control algorithm that can be embedded in the program code portion 11-60 of the controller 5-10 shown in FIGS. 5 and 11. The flow diagram includes five major sections, namely steady-state operation 12-1, new pump addition 12-2, balancing 12-3, returning to balancing state 12-4 and soft stop 12-5.

In steady-state operation 12-1, the process includes testing if one or more of the currently operating pumps are in the inefficient high-Q region (item 4-40 in FIG. 4) or the rotational speed n is above a predefined threshold, such as the pump's nominal speed $n_{nom}$ (12-11). If not, the process proceeds to testing if one or more of the currently operating pumps are in the inefficient high-H region (item 4-30 in FIG. 4). If not, the process proceeds to adjusting the speed n of the currently operating pumps together.

If at least one pump was in the inefficient high-Q region or forbidden high-n region, the process proceeds to the new pump addition block (12-2). In this block, a new pump is started (12-21) and a test is performed to see of the new pump produces flow (12-22). If not, its speed n is increased and the testing is performed again (12-21).

When the newly-added pump produces flow (12-21), the process proceeds to the balancing block (12-3). Herein, a test is performed to see if the heads of the currently operating pumps are equal (12-31). If not, the speed n of the newly-added pump can be raised while the n of the previous pump(s) can be lowered (12-33). When the pumps have reached equal head (12-31), the attained rotational speed n is saved as a rotational speed limit L (12-32). From the balancing block, the process continues to steady-state operation, with the new pump added.

On the other hand, if during the steady-state operation, at least one pump is found to be operating in the high-H region (12-12), the process proceeds to the block named return to balancing state (12-4). A test (12-41) is performed to see if at least one pump is operating at the rotational speed limit L that was determined in the balancing block (12-3). If no pumps are operating at the rotational speed limit L, the rotational speed n of the pumps is decreased (12-42) and the test is performed again (12-41).

If at least one pump is operating at the rotational speed limit L, the process proceeds to the block labelled pump soft stop (12-5). Herein it is tested if the new pump produces flow (12-51). If yes, the rotational speed n of the previous pumps can be increased and that of the new pump can be decreased (12-52), and the test is repeated (12-51). When the new pump ceases to produce flow (12-51), it is stopped (12-53), and the process returns to steady-state operation (12-1), with the recently added pump stopped and removed from the group of currently operating pumps.

It will be apparent to a person skilled in the art that the specific exemplary embodiments illustrate but do not restrict the disclosure, unless explicitly stated otherwise. For instance, the laboratory example described in detail involves a dedicated common controller for individually controlling the rotational speed of each pump, preferably via a respective variable-frequency controller. Instead of such a dedicated common controller, it is possible to integrate the control functionality to one or more of the variable-frequency controllers that can be configured to act in a master-slave or daisy-chain configuration.

In one illustrative implementation, the distribution of the control algorithm is such that each frequency converter calculates the operating point of the pump controlled by that frequency converter and transmits the values to a master frequency converter that calculates the algorithm and controls the slave frequency converters. It is also possible that an individual frequency converter sends a status signal indicating that the pump controlled by it is in the High-Q range and thus a new pump is to be started. A drive next in the chain is then started and it can control the 'Add new pump' and 'Balancing' operations (phases 12-2 and 12-3 of the algorithm shown in FIG. 12), and then release control. Conversely, should a drive detect that a pump controlled by it is in the High-H range, the drive can control the 'Return to balancing state' and 'Pump Soft Stop' operations (phases 12-4 and 12-5 of FIG. 12), and then release control. Hence, distributed control is possible.

Exemplary embodiments of the present disclosure have been described with respect to the operative features the structural components perform. The exemplary embodiments of the present disclosure can also be implemented by at least one processor (e.g., general purpose or application specific) of a computer processing device which is configured to execute a computer program tangibly recorded on a non-transitory computer-readable recording medium, such as a hard disk drive, flash memory, optical memory or any other type of non-volatile memory. Upon executing the program, the at least one processor is configured to perform the operative functions of the above-described exemplary embodiments.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for operating a plurality of pumps with a controller, wherein each pump is modelled by a flow-head model, that indicates a predefined high-efficiency region, a high-H region wherein a head is higher than in the high-efficiency region and a high-Q region wherein a flow is higher than in the high-efficiency region, the flow-head model indicating a rotational speed limit, the method comprising:

dynamically maintaining a current set of operating pumps from among the plurality of pumps; and controlling rotational speed of each pump in the current set of operating pumps, wherein the dynamically maintaining and controlling of rotational speed includes:

a steady-state operation wherein all pumps of the current set of operating pumps are controlled together, so long as the pumps of the current set of operating pumps operate in the high-efficiency region and do not exceed the rotational speed limit;

a pump addition operation, responsive to a detected operation in the high-Q region or beyond the rotational speed limit, wherein a new pump is started and brought to a rotational speed that produces flow and is added to the current set of operating pumps;

a first balancing operation, following the pump addition operation, wherein the rotational speeds of the pumps of the current set of operating pumps are adjusted for equal heads, and wherein the rotational speed of the new pump, when equal heads are achieved, establishes the rotational speed limit; and a pump removal operation, responsive to a detected operation in the high-H region, wherein the current set of operating pumps is decreased by at least one pump.

2. The method according to claim 1, wherein the pump removal operation is preceded by a second balancing operation, comprising:

adjusting the rotational speed of each pump of the current set of operating pumps to the rotational speed limit of the first balancing operation.

3. A control system comprising a controller for controlling a pump system having a plurality of pumps, the controller comprising:

a memory that stores, for each of the plurality of pumps, a flow-head model, that indicates a predefined high-efficiency region, a high-H region wherein a head is higher than in the high-efficiency region, and a high-Q region wherein flow is higher than in the high-efficiency region, the flow-head model indicating a rotational speed limit; and a processor configured to dynamically maintain a current set of operating pumps from among the plurality of pumps and to control rotational speeds of the current set of operating pumps, wherein the rotational speed processor is configured to perform the following operations:

a steady-state operation wherein all pumps of the current set of operating pumps will be controlled together, so long as the pumps of the current set of operating pumps operate in the high-efficiency region and do not exceed the rotational speed limit;

a pump addition operation, responsive to a detected operation in the high-Q region or beyond the rotational speed limit, whereby a new pump is started and brought to a rotational speed that will produce flow and is added to the current set of operating pumps;

a first balancing operation, following the pump addition operation, wherein the rotational speed of the pumps of the current set of operating pumps will be adjusted for equal heads, and wherein the rotational speed of the new pump, when equal heads are achieved, establishes the rotational speed limit; and a pump removal operation, responsive to a detected operation in the high-H region, wherein the current set of operating pumps will be decreased by at least one pump.

4. The control system according to claim 3, comprising:

a variable frequency converter for each pump of the plurality of the pumps, wherein the controller is configured to control rotational speeds of the pumps by controlling input signals to the variable-frequency converters and wherein the flow-head model further will indicate, for each pump, the flow and head as functions of rotational speed, whereby the controller is configured for determining the flow and head of the pumps without dedicated sensors.

5. The control system according to claim 4, wherein the controller is integrated into one or more of the variable-frequency converters.

6. The control system according to claim 3, in combination with a pump system having a plurality of pumps controlled by the controller.

7. The control system in combination with the pump system according to claim 6, comprising:

a variable frequency converter for each pump of the plurality of the pumps, wherein the controller is configured to control rotational speeds of the pumps by controlling input signals to the variable-frequency converters.

8. A control system comprising a controller for controlling a pump system having a plurality of pumps, the controller comprising a memory and a processor;

wherein the memory stores, for each of the plurality of pumps, a flow-head model, that indicates a predefined high-efficiency region, a high-H region wherein a head is higher than in the high-efficiency region, and a high-Q region wherein flow is higher than in the high-efficiency region, the flow-head model indicating a rotational speed limit; and wherein the memory further stores a program code portion that, when executed by the processor, causes the processor to dynamically maintain a current set of operating pumps from among the plurality of pumps and to control rotational speeds of the current set of operating pumps, wherein the processor is configured to perform the following operations:

a steady-state operation wherein all pumps of the current set of operating pumps will be controlled together, so long as the pumps of the current set of operating pumps operate in the high-efficiency region and do not exceed the rotational speed limit;

a pump addition operation, responsive to a detected operation in the high-Q region or beyond the rotational speed limit, whereby a new pump is started and brought to a rotational speed that will produce flow and is added to the current set of operating pumps;

a first balancing operation, following the pump addition operation, wherein the rotational speed of the pumps of the current set of operating pumps will be adjusted for equal heads, and wherein the rotational speed of the new pump, when equal heads are achieved, establishes the rotational speed limit; and a pump removal operation, responsive to a detected operation in the high-H region, wherein the current set of operating pumps will be decreased by at least one pump.

9. The control system according to claim 8, comprising:

a variable frequency converter for each pump of the plurality of the pumps, wherein the controller controls rotational speeds of the pumps by controlling input signals to the variable-frequency converters and wherein the flow-head model further indicates, for each pump, the flow and head as functions of rotational speed, whereby the controller determines the flow and head of the pumps without dedicated sensors.

10. The control system according to claim 8, wherein the controller is integrated into one or more of the variable-frequency converters.

11. The control system according to claim 8, in combination with a pump system having a plurality of pumps controlled by the controller.

12. The control system in combination with the pump system according to claim 11, comprising:

a variable frequency converter for each pump of the plurality of the pumps, wherein the controller controls rotational speeds of the pumps by controlling input signals to the variable-frequency converters.

* * * * *